United States Patent [19]

Palloch et al.

[11] Patent Number: 4,687,461

[45] Date of Patent: Aug. 18, 1987

[54] MULTIPLE ROTARY DRIVE SYSTEM FOR A TEXTILE-WORKING MACHINE

[75] Inventors: Herbert Palloch, Schwetzingen/Baden; Hans Erndt, Weisloch, both of Fed. Rep. of Germany

[73] Assignee: Frankl & Kirchner GmbH & Co KG, Schwetzingen/Baden, Fed. Rep. of Germany

[21] Appl. No.: 862,058

[22] Filed: May 12, 1986

[30] Foreign Application Priority Data

May 10, 1985 [DE] Fed. Rep. of Germany ..... 3516832

[51] Int. Cl.[4] ..... F16H 7/02; B60K 41/24

[52] U.S. Cl. ..... 474/148; 74/665 GE; 112/220; 192/18 B; 474/150

[58] Field of Search ..... 474/148–150, 474/1; 192/18 B, 84 C; 74/665 GE; 112/220, 155

[56] References Cited

U.S. PATENT DOCUMENTS

| | | | |
|---|---|---|---|
| 3,176,641 | 4/1965 | Palmer | 192/18 B |
| 3,921,770 | 11/1975 | Daab et al. | 112/220 X |
| 4,505,366 | 3/1985 | Sangiorgi | 192/18 B |
| 4,549,491 | 10/1985 | Albrecht et al. | 112/73 |
| 4,556,132 | 12/1985 | Lengsfeld et al. | 192/12 BA |
| 4,576,103 | 3/1986 | Albrecht et al. | 112/73 |

FOREIGN PATENT DOCUMENTS 8330328 3/1984 Fed. Rep. of Germany .

*Primary Examiner*—James A. Leppink
*Assistant Examiner*—Hoang C. Dang
*Attorney, Agent, or Firm*—Felfe & Lynch

[57] ABSTRACT

A multiple rotary drive system for a textile-working machine has first and second clutch-brake units. Each clutch-brake unit has a rotatable flywheel, a non-rotatable brake surface, and a rotatable shaft to be driven, whereby the rotatable shaft can be connected to the textile-working machine as a rotary drive of the system therefor. A clutch disc and a brake disc of each clutch-brake unit are connected to the shaft thereof for rotation therewith and are arranged for controllably engaging with, respectively, the flywheel for rotatably driving the shaft therefrom and the brake surface for braking rotation of the shaft therefrom. The flywheel of the first clutch-brake unit is rotationally driven, whereby the drive system can be driven by a continuously-rotating shaft of a continuously-operating electric motor. A belt extends about each flywheel for coordinate rotation of the flywheels when the one is rotatably driven by the electric motor. Then, when the clutch disc of either or both of the clutch-brake units is engaged with the flywheel thereof, the shaft thereof is rotatably driven in coordination with the drive of the one flywheel and the shaft of the other clutch-brake unit if its clutch disc is also engaged with its flywheel.

12 Claims, 10 Drawing Figures

MULTIPLE ROTARY DRIVE SYSTEM FOR A TEXTILE-WORKING MACHINE

BACKGROUND OF THE INVENTION

The invention relates to a multiple rotary drive system for a textile-working machine, for example, and a sewing machine, for more-specific example.

In a number of different textile-working machines, such as knitting machines or sewing machines, for example, two or more shafts which, in some cases, are very close together, have to be driven in coordination with one another but must be controllable independently of one another. One way of doing this would be to use an electric motor, and a stepper or a pulse-driven DC motor, more particularly, for rotating each shaft with electric pulse devices for coordinating the motors and, hence, the rotation of the individual shafts. For example, a pulse-emitting device on a first shaft could emit pulses in dependence upon the rotary speed the shaft, which thus assumes the character of a master shaft, to provide the basis for control of the rest of the shafts, which thus assume the character of slave shafts, with relative speed differences between any of the shafts produced electronically by frequency dividers or pulse-width changers, for example. Such solutions involving several independent electric motors operated in coordination are, however, technically complex and also require a relatively large amount of space, especially if it is necessary to provide each motor with additional equipment, such as cooling systems and the like.

U.S. Pat. No. 4,549,491 discloses another multiple-shaft rotary drive for a stitch group sewing machine.

U.S. Pat. No. 4,556,132 discloses a rotary drive for a sewing machine. It has an electric motor continuously operating at constant speed and a clutch-brake unit to produce a driving connection between the driving shaft of the electric motor and a driven shaft of the sewing machine by selective excitation of clutch or brake coils of the clutch-brake unit. On account of the extremely advantageous characteristics of this or similar drive systems, which are also developed technically to a high degree, it might appear desirable to drive plural shafts with a corresponding number of independent drives of this kind, but this would involve considerable cost and, in many applications, would be infeasibly large for the limited amount of available space.

German Utility Model Publication No. 83 30 328 discloses a buttonhole sewing machine having an electric motor driving a clutch-brake unit. The driven shaft of the clutch-brake unit is connected to two electromagnetic clutches, one of which produces a driving connection to an upper, sewing-instrumentality shaft of the sewing machine and the other, a driving connection for moving a feed dog. By actuating the latter clutch, the feed dog can be brought quickly into position before and after the actual sewing, and by actuating the former clutch, the sewing is produced while the feed dog is driven in the conventional manner, the latter clutch not being engaged in this phase.

U.S. Pat. No. 4,274,522 discloses a machine having a low-speed auxiliary motor in addition to a high-speed main motor. By an electromagnetic clutch and auxiliary V-belt, the auxiliary motor can be used to drive the main shaft otherwise driven by the main motor whenever the machine is to be driven by the low-speed auxiliary motor instead of the high-speed main motor for certain operations.

SUMMARY OF THE INVENTION

An object of the invention is, therefore, to provide a multiple rotary drive system that can be produced economically, that utilizes the advantageous properties and mature development of known clutch-brake drives, that is small for installation in limited space, and that can be retrofit into known textile-working machines without major alterations.

To this and other ends, the invention provides a multiple rotary drive system for coordinate rotation of shafts of a textile-working machine, for example, and a sewing machine, for more-specific example. The drive system has at least first and second clutch-brake units. Each clutch-brake unit has a rotatable flywheel, a non-rotatable brake surface, a rotatable shaft to be driven, a clutch disc and a brake disc each connected to the shaft for rotation therewith, and an arrangement for controllably engaging the clutch disc with the flywheel for rotatably driving the shaft therefrom and the brake disc with the brake surface for braking rotation of the shaft therefrom. The flywheel of each clutch-brake unit is arranged for receiving a belt, for example with a V-shaped groove circumferentially about the flywheel for receiving a V-belt, and the drive system includes a belt between the flywheels for coordinate rotation of the flywheels when one is rotatably driven. One of the flywheels, hereafter designated the flywheel of the first clutch-brake unit, is, therefore, also arranged to be rotatably driven, for example by connection to a continuously-rotated shaft of a continuously-operating electric motor. Selective control of the clutch and brake discs of the clutch-brake units thus provides selective, but coordinated rotation of the shafts of the clutch-brake units which may then be connected to shafts of a textile-working machine such as a sewing machine, for example, for so driving the connected shafts of the machine.

By having at least two clutch-brake units, only one of which is driven by an electric motor, it is possible to provide highly-variable drive ratios within a small amount of space at high efficiency. The drive ratios and high efficiency are achieved because the electric motor driving the clutch-brake units runs continuously and so do, therefore, the flywheels of the clutch-brake units which are drivingly connected to the electric motor and, merely by activating the arrangement for controllably engaging the clutch and brake discs, for example by energizing individual clutch or brake coils of the individual clutch-brake units therefor, the driven shafts of the clutch-brake units can be driven with the highly-developed efficiency thereof either completely in synchronism, i.e., correlatedly with one another, or entirely independently of one another.

With a suitable driving or driven connection between the clutch-brake units, it is possible to achieve a reverse drive by energizing the clutch windings of only one unit, i.e., to make one or more of the shafts of the clutch-brake units selectively run forward or in reverse, regardless of the direction of rotation of the shaft of the driving electric motor.

BRIEF DESCRIPTION OF THE DRAWINGS

Other features, advantages and details of the invention will appear from the following description of merely preferred embodiments which illustrate but do not limit the invention, the description thereof being made in conjunction with drawings, wherein.

DESCRIPTION OF THE PREFERRED EMBODIMENTS

Figure 1:
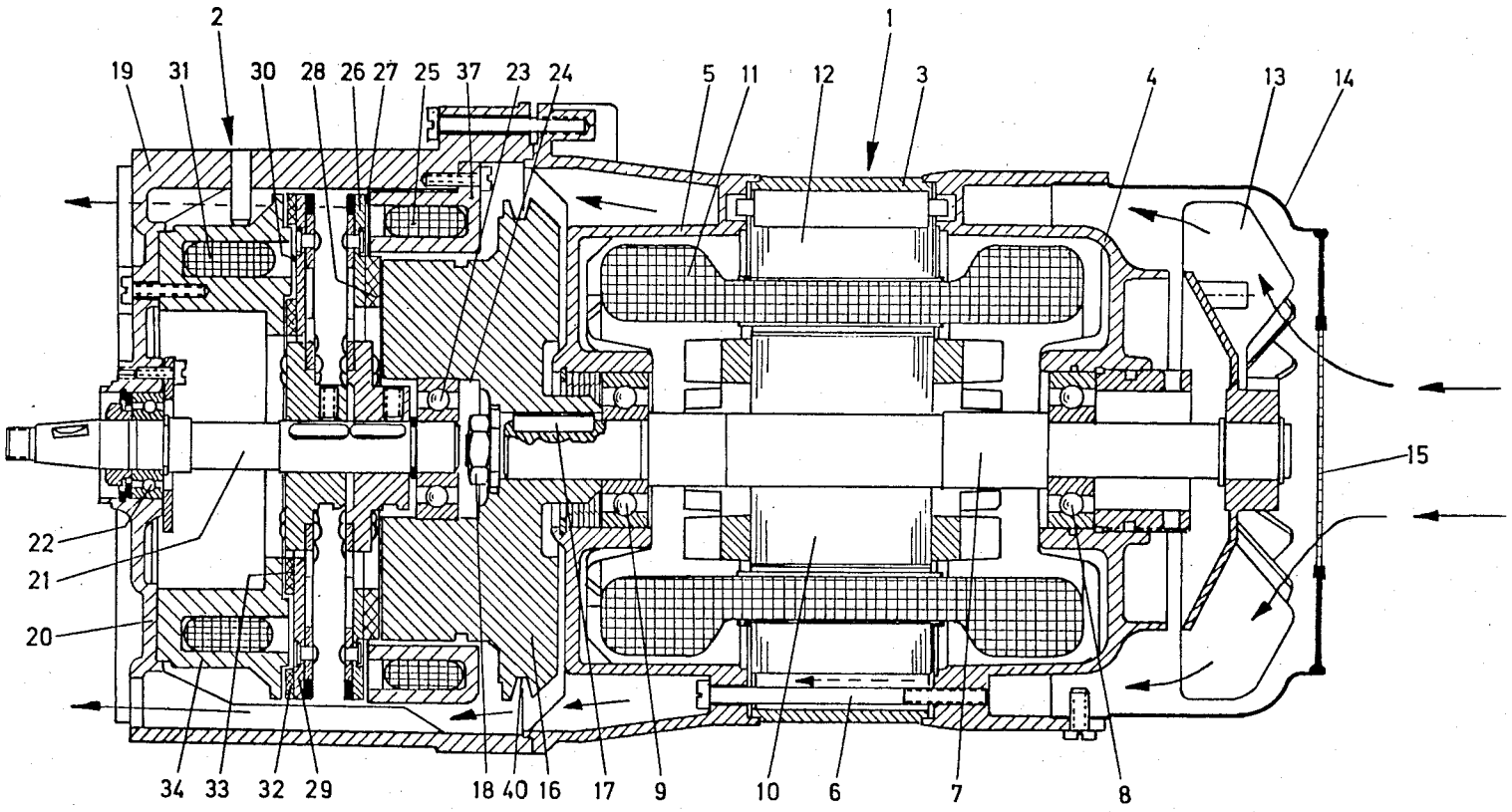
FIG. 1 is a cross-sectional, axial elevation of a first clutch-brake unit of one preferred embodiment, together with an electric motor drivingly connected thereto.

FIG. 1 shows a continuous-running, asynchronous, short-circuit-rotor motor at 1 with a first clutch-brake unit at 2 of one preferred embodiment flange-mounted coaxially at one end thereof. The motor has a cylindrical stator case 3 with bearing shells 4 and 5 flange-mounted at the ends thereof by through-going tension bolts 6 (only one shown). A shaft 7 is rotatably mounted on ball bearings 8 and 9 in the bearing shells. A laminated rotor 10 is coaxially mounted on the shaft 7 for rotation therewith. A stator winding 11 and a laminated stator 12 are disposed concentrically thereabout on the stator case. A fan 13 is mounted on one end of the shaft 7 for rotation therewith to force cooling air through the motor. The fan is shrouded with a cover 14 mounted on the adjacent bearing shell 4. The cover has a screen 15 across an opening therein through which the cooling air is drawn. Such a motor is known.

The first clutch-brake unit at 2 is on the end of the motor at 1 opposite the fan 13. It has a flywheel 16 coaxially affixed to the shaft 7 of the motor, axially by a nut 18 and radially by a key-and-slot coupling 17. The flywheel 16 has a V-shaped groove 40 circumferentially thereabout for receiving a V-belt (41 in FIGS. 2 to 6).

A cylindrical, outer portion 19 of the clutch-brake unit at 2 about the flywheel 16 is flange-mounted at one end coaxially on the bearing shell 5 adjacent the flywheel 16 by screws. At its other end, remote from the motor at 1 and its bearing shell 5, the cylindrical, outer portion 19 is closed by a bearing shell 20 which is integral therewith. A driven shaft 21 of the clutch-brake unit at 2 is mounted coaxially with the shaft 7 of the motor at 1 on ball bearings 22 in the bearing shell 20 at one end and on ball bearings 23 in a bearing bore 14 in the flywheel 16 at the other end.

A winding 25 for an electromagnetic clutch is disposed concentrically around the flywheel 16 by an exo-core 37 surrounding the winding on three sides and fastened to the inside of the cylindrical, outer portion 19 of the clutch-brake unit at 2. A clutch disc 26 of the electromagnetic clutch is affixed to the driven shaft 21 of the clutch-brake unit for rotation therewith. The clutch disc is made of a magnetic material such as iron so that, when the coil 25 is energized, the clutch disc 26 is attracted across an air gap 27 between the core 37 and clutch disc 26 to bring friction facings 28 of the clutch disc 26 into engagement with an opposite face of the flywheel 16. The driven shaft 21 is then rotationally coupled to the motor shaft 7.

A winding 31 of an electromagnetic brake and its exo-core 34, surrounding it on three sides, is similarly disposed in the cylindrical, outer portion 19 of the clutch-brake unit at 2, spaced concentrically around its driven shaft 21, at the other end from the flywheel 16 and clutch disc 26, and fastened, non-rotatably, to the bearing shell 20. A brake disc 29 of the electromagnetic brake is mounted on the driven shaft 21 for rotation therewith. When the coil 31 is energized, the brake disc 29, also being of a magnetic material such as iron, is attracted across an air gap 30 between core 34 and brake disc 29 to engage a brake face of the core 34, thereby producing a braking action on the driven shaft 21.

The construction and manner of operation of such a clutch-brake unit are described in U.S. Pat. No. 3,543,901, which description is incorporated herein by reference.

A free end of the driven shaft 21 of the first clutch unit at 2 carries a belt pulley 38 (FIGS. 4 to 6) for rotation with the driven shaft. The belt pulley 38 serves, in the present embodiment, to drive an overlock sewing machine at 62 (FIG. 5).

Figure 2:
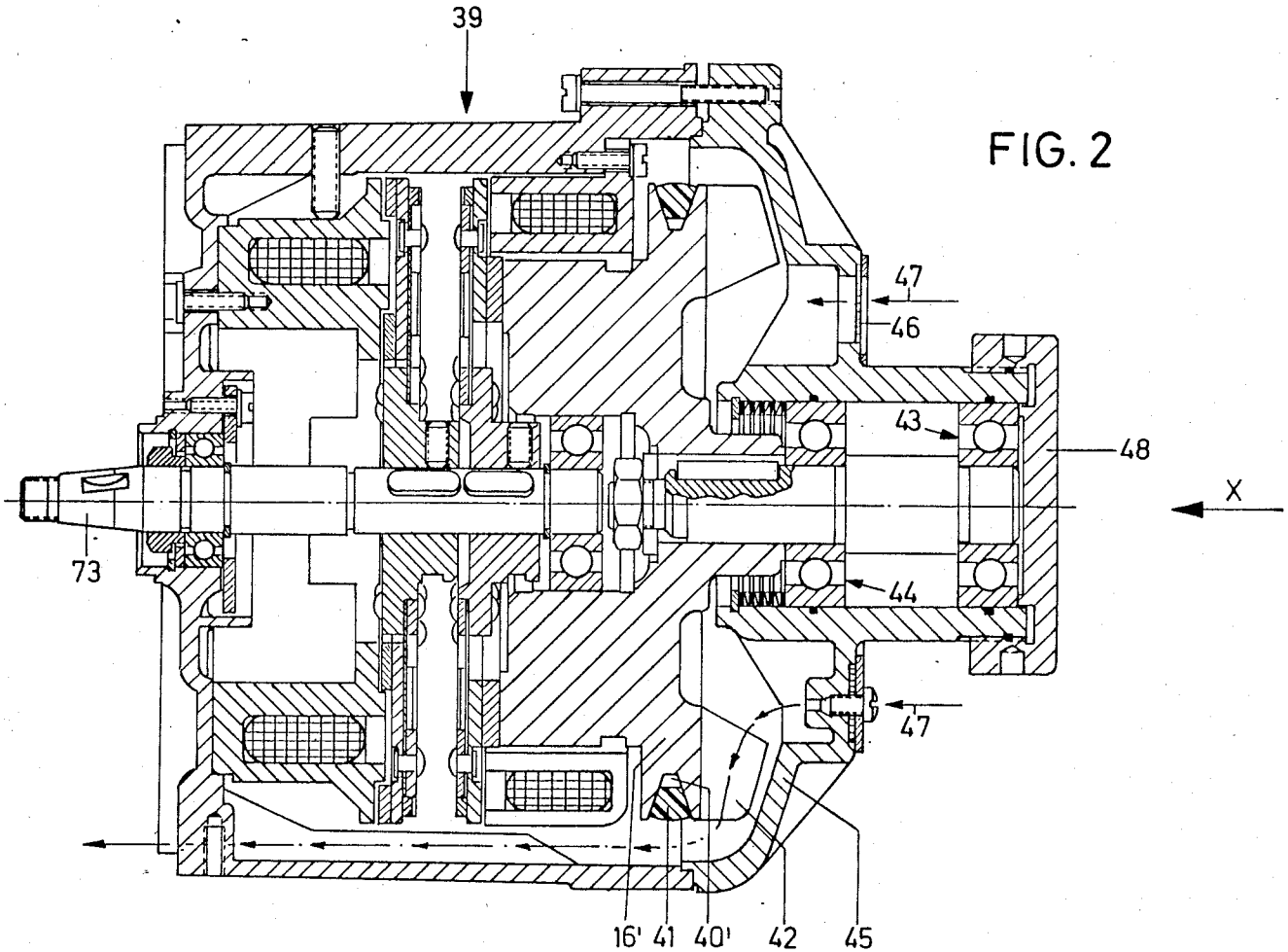
FIG. 2 is a cross-sectional, axial elevation along line II—II of FIG. 3, of a second clutch-brake unit of the one preferred embodiment.
Figure 3:
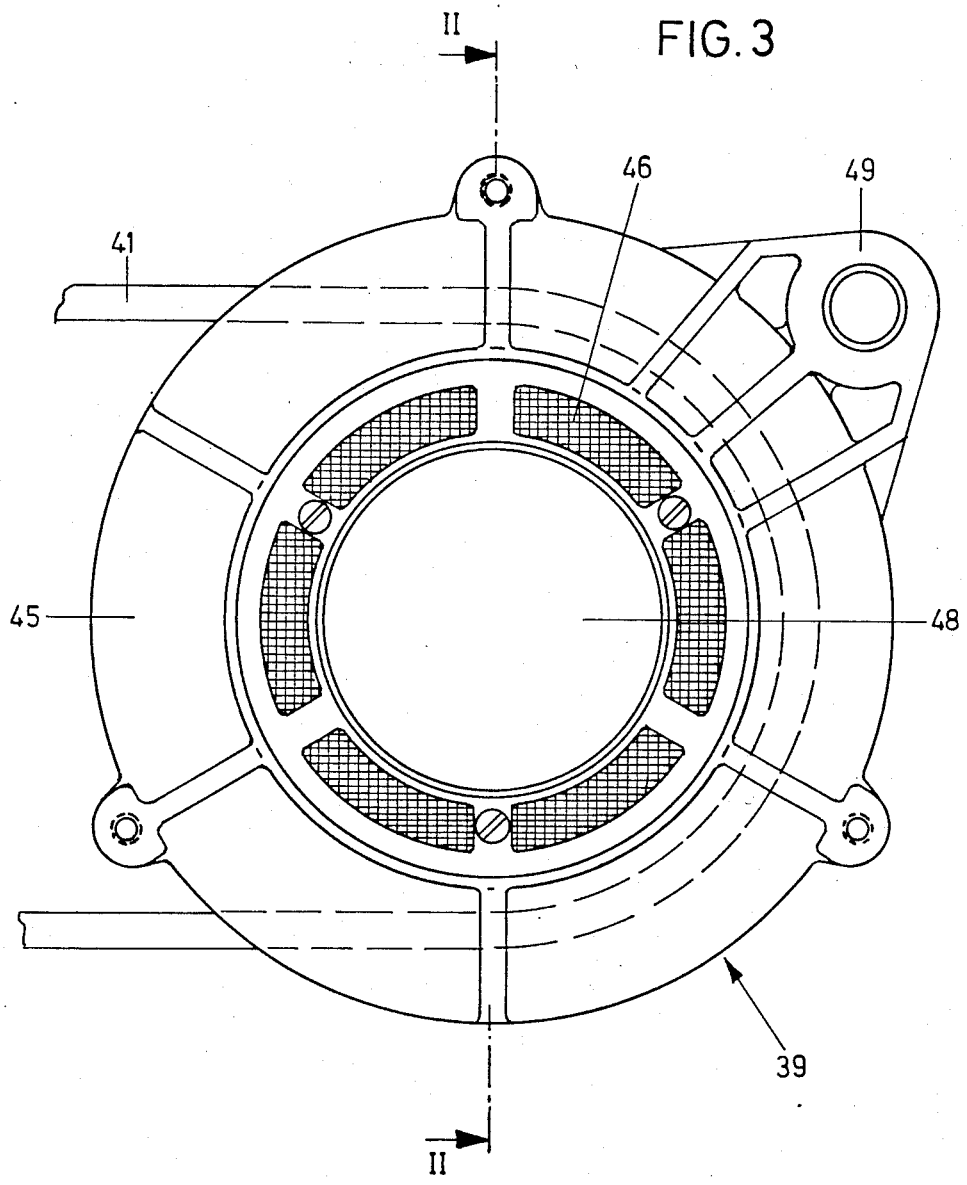
FIG. 3 is a front-end view of the second clutch-brake unit of FIG. 2.

A second clutch-brake unit at 39, as shown in detail in FIGS. 2 and 3, has a construction that is, substantially, identical to that the of the first clutch-brake unit at 2, as shown in detail in FIG. 1 and described above. Its flywheel 16′ therefore also has a V-shaped belt-receiving groove 40′ circumferentially thereabout. Other substantial identities need not be described again.

The second clutch-brake at 39 differs from the first at 2, however, in that the flywheel 16′ has a fan 42 like the fan 13 (FIG. 1) of the electric motor at 1 (FIG. 1). For this, the flywheel 16′ is bolted and keyed to a shaft mounted on ball bearings 43 and 44 of a final bearing shell 45 covering the front end of the second clutch-brake unit at 39. The final bearing shell 45 has a screen 46 corresponding to the fan screen 15 (FIG. 1) of the motor at 1 (FIG. 1). The arrows 47 indicate the direction of the ventilation. A threaded cap 48 on the final bearing shell 45 permits axial shifting of the flywheel 16′ in a manner known in itself. A mounting ear 49 (FIG. 3) of a bracket about the second clutch-brake unit at 39 serves for connecting it to a turning link 50 (FIG. 4) for mounting the second clutch-brake unit at 39 to a mounting plate 51 (FIG. 4).

Figure 4:
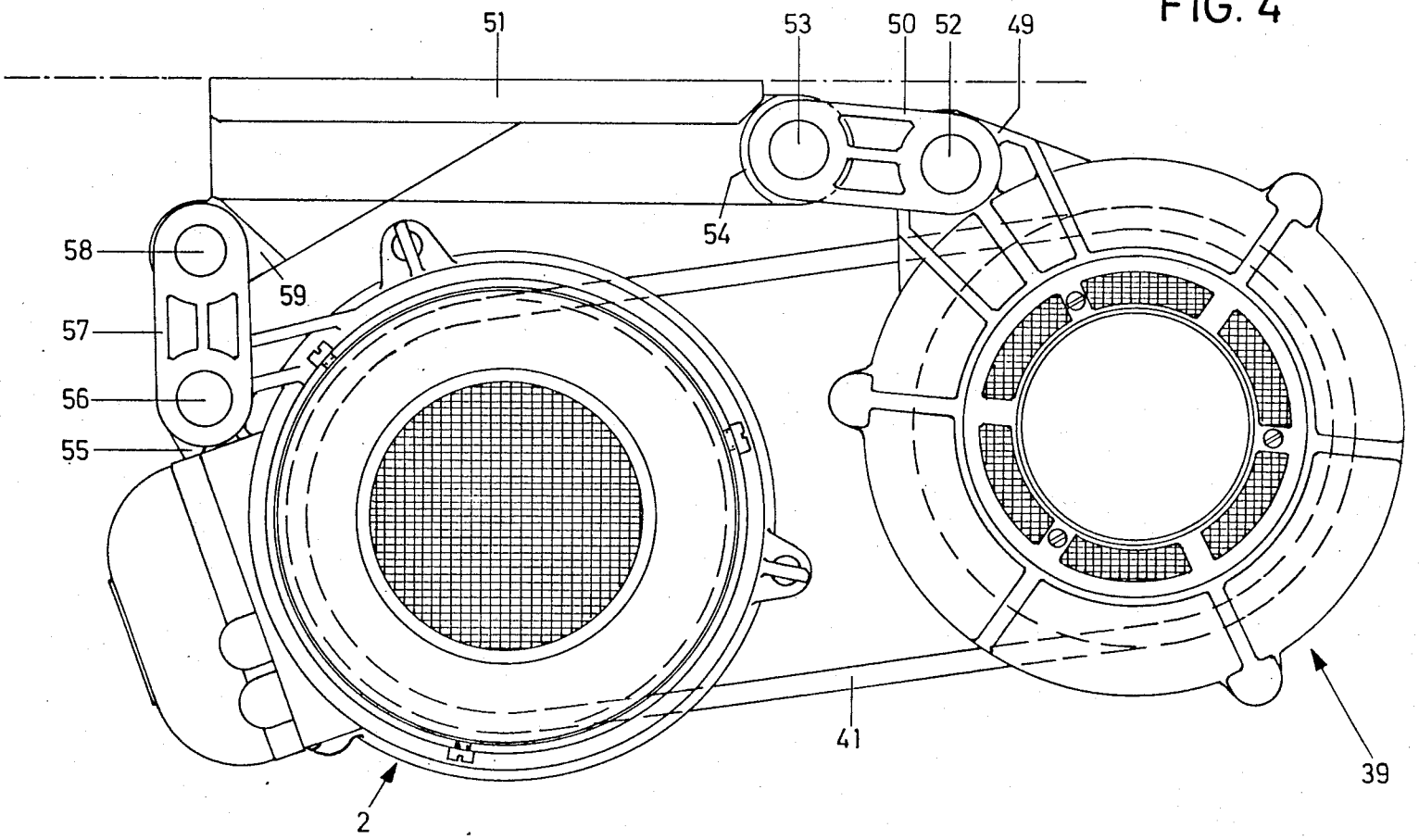
FIG. 4 is a front-end view of the first clutch-brake unit with electric motor of FIG. 1 in operative association with the second clutch-brake unit of FIG. 3 (in a different position) on a common mounting plate therefor.
Figure 5:
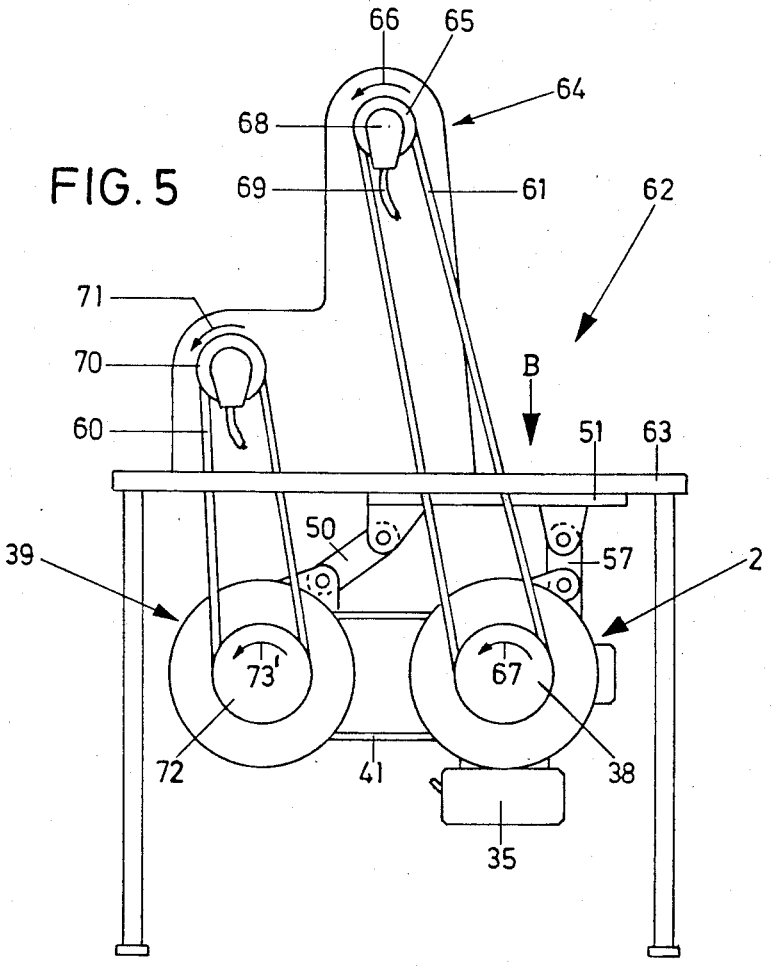
FIG. 5 is a rear-end view of the preferred embodiment, motor and mounting plate of FIG. 4 together with the sewing machine having the mounting plate on a sewing table thereof.

FIG. 4 shows a way in which the first and second clutch-brake units at 2 and 39, respectively, can be fastened, in common, to the mounting plate 51. A lockable pivot (e.g., in the form of a screw with a nut) 52 joins the ear 49 of the second clutch-brake unit to a link 50 and a second lockable pivot 53 connects the link to an eye 54 of the mounting plate 51. In like manner, the first clutch-brake unit at 2 is provided with an ear 55 which is joined by a lockable pivot 58 to another ear 59 of the mounting plate 51. This arrangement makes it possible to adjust or readjust both the tension of a V-belt 41 which extends about the flywheels 16 (FIG. 1) and 16' (FIG. 2) received in their respective grooves 40 (FIG. 1), 40' (FIG. 2); as well as V-belts 60 and 61 (FIG. 5).

FIG. 5 shows the installation of the above-described drive system in a so-called overlock sewing machine at 62. The overlock sewing machine, which is represented only diagrammatically, has a sewing table 63. The mounting plate 51 is fastened underneath the table. A head at 64 of the sewing machine at 62 is disposed on the other, top side of the sewing table.

The drive to the main shaft (not shown), but as known from German patent publication OS No. 33 20 158, for example, and incorporated herein therefrom by reference of the sewing machine at 62 is delivered through a belt pulley 65 in the direction of the arrow 66. The belt pulley 65 is driven through a V-belt 61 thereabout, and also about a belt pulley 38 (also shown in FIG. 6) fastened to the driven shaft 21 of the first clutch-brake unit at 2. The belt pulley 38 turns in the direction of the arrow 67, i.e., in the same sense as the belt pulley 65. A position sensing pickup 68 is also disposed on the main shaft. Its electrical cable 69 is connected to a control box 35 that is fastened to the first clutch-brake unit at 2.

Another belt pulley 70 serves to drive the so-called overlock feed dog. The belt pulley 70 is driven in the direction of the arrow 71 through a V-belt 60 thereabout, the V-belt 60 also extending about a belt pulley 72 (also shown in FIG. 6) on the driven shaft 73 of the second clutch-brake unit at 39. The belt pulley 72 turns in the direction of the arrow 73', that is, in the same direction as the belt pulley 38 of the first clutch-brake unit at 2 and the belt pulley 70 of the overlock feed dog.

Figure 6:
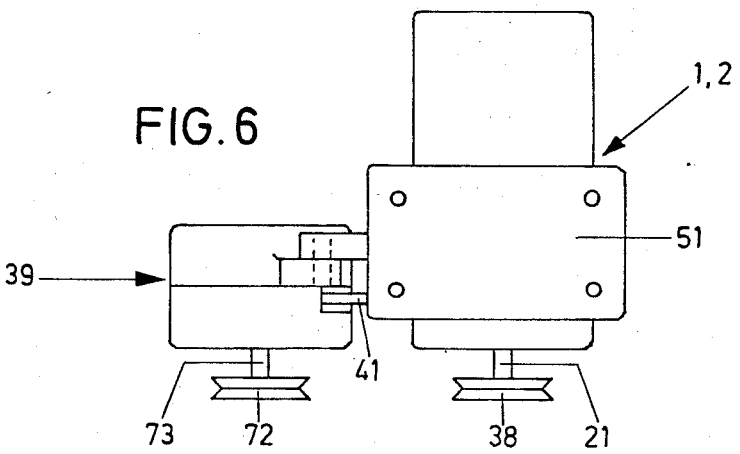
FIG. 6 is a diagrammatic top view of the preferred embodiment and mounting plate of FIG. 4.
Figure 7:
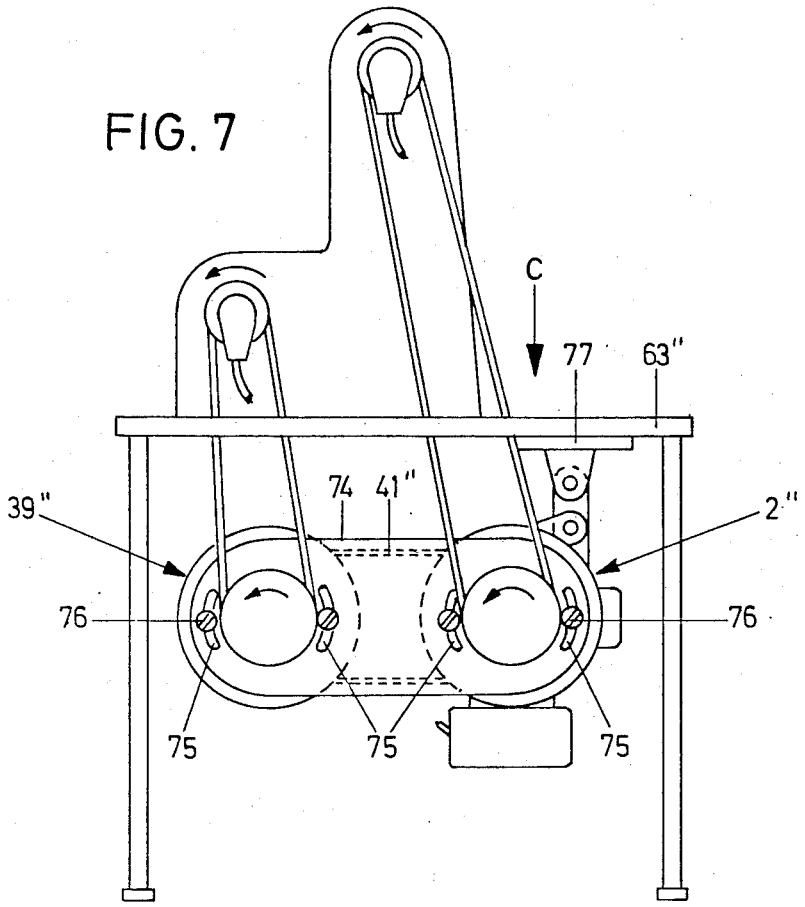
FIG. 7 is a rear-end view, similar to FIG. 5, of another preferred embodiment, together with a motor, mounting plate and sewing machine and table therefor.
Figure 8:
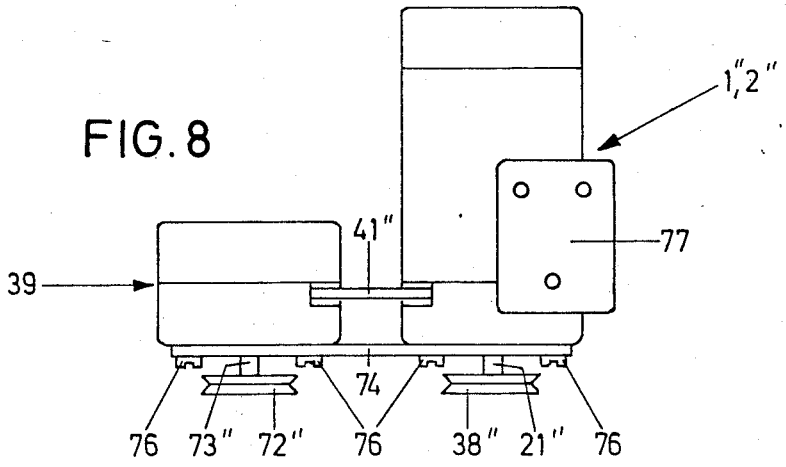
FIG. 8 is a diagrammatic top view, similar to FIG. 6, of the preferred embodiment of FIG. 7 together with a motor and mounting plate therefor.

FIGS. 7 and 8 show a similar embodiment represented in the same manner as in FIGS. 5 and 6, except that the second clutch-brake unit is not fastened directly to a common mounting plate 51'' on the sewing table 63'', but to a plate 74. The plate 74 has slots 75 of arcuate configuration concentric with the driven shafts 73'' and 21'', respectively, through which screws 76 are passed for locking the clutch-brake units at 2'' and 39'' in place. This configuration also permits adjustment of the belt tension; although, of course, other arrangements not shown in the drawing could also be provided. The clutch-brake unit at 2'' with the electric motor at 1'' is joined to the sewing table 63 by a mounting plate 77, similarly to the embodiment shown in FIGS. 5 and 6.

It is apparent both from FIGS. 6 and 8 that the driven shafts 21 and 73 of the clutch-brake units at 2, 2'' and 39, 39'', respectively, are situated relatively close together and parallel with one another in one plane. This permits an especially simple installation on conventional overlock sewing machines without complex and expensive adaptation.

Figure 9:
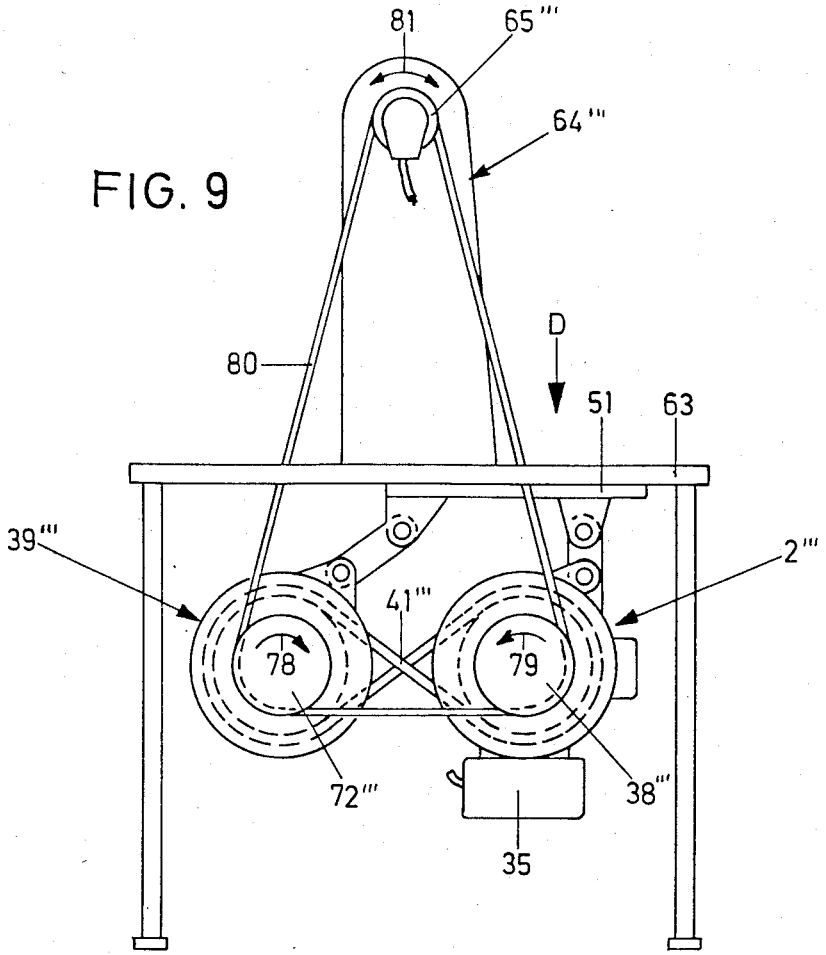
FIG. 9 is a rear-end view, similar to FIGS. 5 and 7, together with a mounting plate therefor; and, FIG. 10 is a diagrammatic top view, similar to FIGS. 6 and 8, of the preferred embodiment of FIG. 9 together with the mounting plate therefor.
Figure 10:
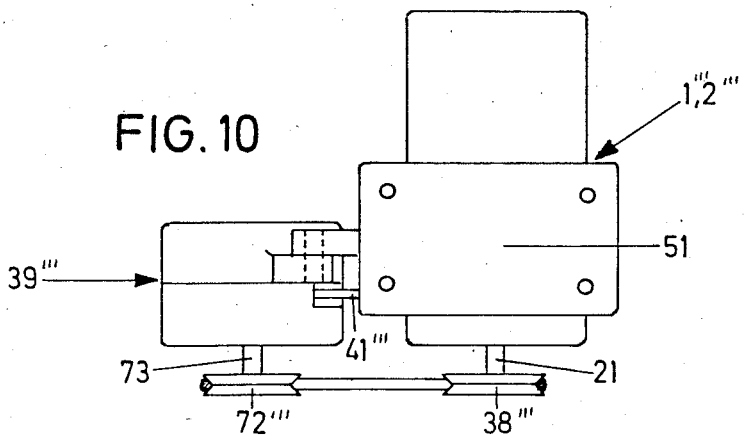

The embodiment represented in FIGS. 9 and 10 is substantially the same in its basic construction as the embodiment shown in FIGS. 5 and 6, but the feed dog is not driven by the second clutch-brake unit. Instead, the feed dog drive is derived from the main shaft in a conventional manner. In this embodiment, the second brake-clutch unit at 39'' is used for achieving reverse operation in an especially simple manner. For this, the V-belt 41''' is crossed so that the respective flywheels 16''' and 16'''', as indicated by the arrows 78 and 79, run in opposite directions. A V-belt 80 is laid about two belt pulleys 72''' and 38''' of the first and second clutch-brake units at 2''' and 39''', respectively, and around the belt pulley 65''' on the main shaft of the sewing machine 64'''. As indicated by the arrow 81, a reversal of the rotation of the main shaft can be accomplished by alternately engaging one or the other of the clutch-brake units at 2''' and 39'''.

It will be understood that the specification and examples are illustrative but not limitative of the present invention and that other embodiments within the spirit and scope of the invention will suggest themselves to those skilled in the art.

What is claimed is:

1. A multiple rotary drive system for a textile-working machine, comprising:

first and second clutch-brake units, each clutch-brake unit having a rotatable flywheel, a non-rotatable brake surface, a rotatable shaft to be driven, whereby the rotatable shaft can be connected to a textile-working machine as a rotary drive system therefor, at least one coupling disc connected to the shaft for rotation therewith, first engaging means for controllably engaging one of said at least one disc with the flywheel for rotatably driving the shaft therefrom, and second engaging means for controllably engaging one of said at least one disc with the brake surface for braking rotation of the shaft therefrom;

drive means connected to the flywheel of the first clutch-brake unit for rotationally driving the flywheel thereof, whereby the drive system can be driven by a continuously-rotating shaft of a continuously-operating electric motor;

belt-receiving means about the flywheel of each clutch-brake unit for receiving a belt; and a belt about the belt-receiving means for coordinate rotation of the flywheels of said first and second clutch-brake units.

2. The multiple rotary drive system of claim 1, wherein the belt-receiving means about the flywheel of each clutch-brake unit comprises a V-shaped groove thereabout and the belt is a V-shaped belt for receipt therein.

3. The multiple rotary drive system of claim 1, and further comprising:

first and second lockable links respectively for the first and second clutch-brake units, each lockable link having pin-receiving means for receiving a lockable pivot pin at opposite ends thereof;

a lockable pivot pin in the pin-receiving means at one end of each lockable link; and means on each clutch-brake unit for receiving one of the lockable pivot pins, whereby the clutch-brake units can be mounted independently on a support by lockable pivot pins in the pin-receiving means at the other ends of the lockable links.

4. The multiple rotary drive system of claim 2, and further comprising:

first and second lockable links respectively for the first and second clutch-brake units, ech lockable link having pin-receiving means for receiving a lockable pivot pin at opposite ends thereof;

a lockable pivot pin in the pin-receiving means at one end of each lockable link; and means on each clutch-brake unit for receiving one of the lockable pivot pins, whereby the clutch-brake units can be mounted independently on a support by lockable pivot pins in the pin-receiving means at the other ends of the lockable links.

5. The multiple rotary drive system of claim 1, and further comprising:

a support plate having first and second curved slots respectively for the first and second clutch-brake units concentric of the shafts thereof; and means comprising a lock screw for adjustably connecting the first and second clutch-brake units respectively to the first and second curved slots of the support plate.

6. The multiple rotary drive system of claim 2, and further comprising:

a support plate having first and second curved slots respectively for the first and second clutch-brake units concentric of the shafts thereof; and means comprising a lock screw for adjustably connecting the first and second clutch-brake units respectively to the first and second curved slots of the support plate.

7. The multiple rotary drive system of claim 1, and further comprising:

another rotatable shaft;

means for connecting the shaft of each of the first and second clutch-brake units to the other rotatable shaft for rotating the other rotatable shaft in the same direction as the rotation of the shaft of either of the first and second clutch-brake units; and means comprising a cross in the belt about about the belt-receiving means of the flywheels of the first and second clutch brake units for rotating the flywheels thereof in opposite directions.

8. The multiple rotary drive system of claim 2, and further comprising:

another rotatable shaft;

means for connecting the shaft of each of the first and second clutch-brake units to the other rotatable shaft for rotating the other rotatable shaft in the same direction as the rotation of the shaft of either of the first and second clutch-brake units; and means comprising a cross in the belt about about the belt-receiving means of the flywheels of the first and second clutch brake units for rotating the flywheels thereof in opposite directions.

9. The multiple rotary drive system of claim 3, and further comprising:

another rotatable shaft;

means for connecting the shaft of each of the first and second clutch-brake units to the other rotatable shaft for rotating the other rotatable shaft in the same direction as the rotation of the shaft of either of the first and second clutch-brake units; and means comprising a cross in the belt about about the belt-receiving means of the flywheels of the first and second clutch brake units for rotating the flywheels thereof in opposite directions.

10. The multiple rotary drive system of claim 4, and further comprising:

another rotatable shaft;

means for connecting the shaft of each of the first and second clutch-brake units to the other rotatable shaft for rotating the other rotatable shaft in the same direction as the rotation of the shaft of either of the first and second clutch-brake units; and means comprising a cross in the belt about about the belt-receiving means of the flywheels of the first and second clutch brake units for rotating the flywheels thereof in opposite directions.

11. The multiple rotary drive system of claim 5, and further comprising:

another rotatable shaft;

means for connecting the shaft of each of the first and second clutch-brake units to the other rotatable shaft for rotating the other rotatable shaft in the same direction as the rotation of the shaft of either of the first and second clutch-brake units; and means comprising a cross in the belt about about the belt-receiving means of the flywheels of the first and second clutch-brake units for rotating the flywheels thereof in opposite directions.

12. The multiple rotary drive system of claim 6, and further comprising:

another rotatable shaft;

means for connecting the shaft of each of the first and second clutch-brake units to the other rotatable shaft for rotating the other rotatable shaft in the same direction as the rotation of the shaft of either of the first and second clutch-brake units; and means comprising a cross in the belt about about the belt-receiving means of the flywheels of the first and second clutch brake units for rotating the flywheels thereof in opposite directions.

* * * * *